US006527529B2

(12) United States Patent
Bodzak et al.

(10) Patent No.: US 6,527,529 B2
(45) Date of Patent: Mar. 4, 2003

(54) GEARED FEED PUMP HAVING A PLATELIKE COVER ELEMENT AND AN INDENTED END CAP

(75) Inventors: Stanislaw Bodzak, Elsbethen (AT); Bodo Grebner, Puch (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/859,474

(22) Filed: May 18, 2001

(65) Prior Publication Data

US 2002/0021978 A1 Feb. 21, 2002

(30) Foreign Application Priority Data

May 19, 2000 (DE) ..... 100 24 884

(51) Int. Cl.[7] ..... F04C 2/18

(52) U.S. Cl. ..... 418/133; 418/135; 418/179; 418/206.6

(58) Field of Search ..... 418/133, 135, 418/179, 206.6

(56) References Cited

U.S. PATENT DOCUMENTS

| | | | | |
|---|---|---|---|---|
| 1,694,805 A | * | 12/1928 | Wiltse | 418/133 |
| 2,345,975 A | * | 4/1944 | Herman | 418/179 |
| 2,622,534 A | * | 12/1952 | Johnson | 418/179 |
| 2,702,509 A | * | 2/1955 | Garnier | 418/133 |
| 3,153,371 A | * | 10/1964 | Miller | 418/133 |
| 3,695,791 A | * | 10/1972 | Brundage | 418/133 |
| 4,061,446 A | * | 12/1977 | Sakamaki et al. | 418/133 |
| 5,156,540 A | * | 10/1992 | Fernau et al. | 418/179 |

FOREIGN PATENT DOCUMENTS

| | | | | |
|---|---|---|---|---|
| GB | 1329969 | * | 9/1973 | 418/133 |
| JP | 60-62682 | * | 4/1985 | 418/133 |

* cited by examiner

*Primary Examiner*—John J. Vrablik
(74) *Attorney, Agent, or Firm*—Ronald E. Greigg

(57) ABSTRACT

The geared feed pump has a housing, in which a pump chamber is formed between a housing part and a cap part, and a pair of gear wheels, driven to rotate and meshing with one another on their outer circumference, are disposed in the pump chamber and pump a feed medium into a pressure chamber along feed conduits formed between the outer circumference of the gear wheels and circumferential walls of the pump chamber. On its inside toward the face ends of the gear wheels, the cap part has an indentation with a cross section that is at least as large as the cross section of the face ends of the gear wheels. Between the cap part and the face ends of the gear wheels, a platelike cover element covering the indentation is disposed; at least when the geared feed pump is not in operation, the cover element rests with initial tension on the face ends of the gear wheels and can be deflected into the indentation, away from the face ends of the gear wheels.

19 Claims, 4 Drawing Sheets

GEARED FEED PUMP HAVING A PLATELIKE COVER ELEMENT AND AN INDENTED END CAP

BACKGROUND OF THE INVENTION

1. Field of the Invention

The invention is directed to pumps, and more particularly to an improved geared feed pump.

2. Description of the Prior Art

One known geared feed pump known from German Patent Disclosure DE 196 38 332 has a housing, in which a pump chamber is formed between a housing part and a cap part. A pair of gear wheels that mesh with one another on their outer circumference are disposed, such that they can be driven to rotate, in the pump chamber. The gear wheels pump a feed medium from an intake chamber, communicating with a tank, into a pressure chamber, along feed conduits formed between the circumference of the gear wheels and circumferential walls of the pump chamber. The pump chamber is defined by the cap part, which is located opposite the face ends of the gear wheels and which is meant to rest as tightly as possible against the face ends of the gear wheels, so as to achieve secure sealing of the feed conduits and thus good efficiency of the geared feed pump. On the other hand, however, some play in the direction of the pivot axes of the gear wheels between their face ends and the cap part is necessary, to assure that the gear wheels can be driven to rotate with little friction. The requisite play must be assured even when the geared feed pump is being put together, and furthermore, because of heating during operation of the geared feed pump, this play varies, especially when the gear wheels on the one hand and the housing part and the cap part on the other are of different materials.

OBJECT AND SUMMARY OF THE INVENTION

The geared feed pump of the invention has the advantage over the prior art that by means of the cover element, secure sealing of the feed conduits is achieved, and a requisite play in the direction of the pivot axes of the gear wheels can be established counter to the initial tension of the cover element.

In one embodiment of the invention the initial tension of the cover element is generated in a simple way. In another embodiment, feed medium and/or air can be positively displaced out of the indentation upon the motion of the cover element into the indentation.

BRIEF DESCRIPTION OF THE DRAWINGS

The invention will be better understood and further objects and advantages thereof will become more apparent from the ensuing detailed description taken in conjunction with the drawings, in which.

DESCRIPTION OF THE PREFERRED EMBODIMENTS

Figure 1:
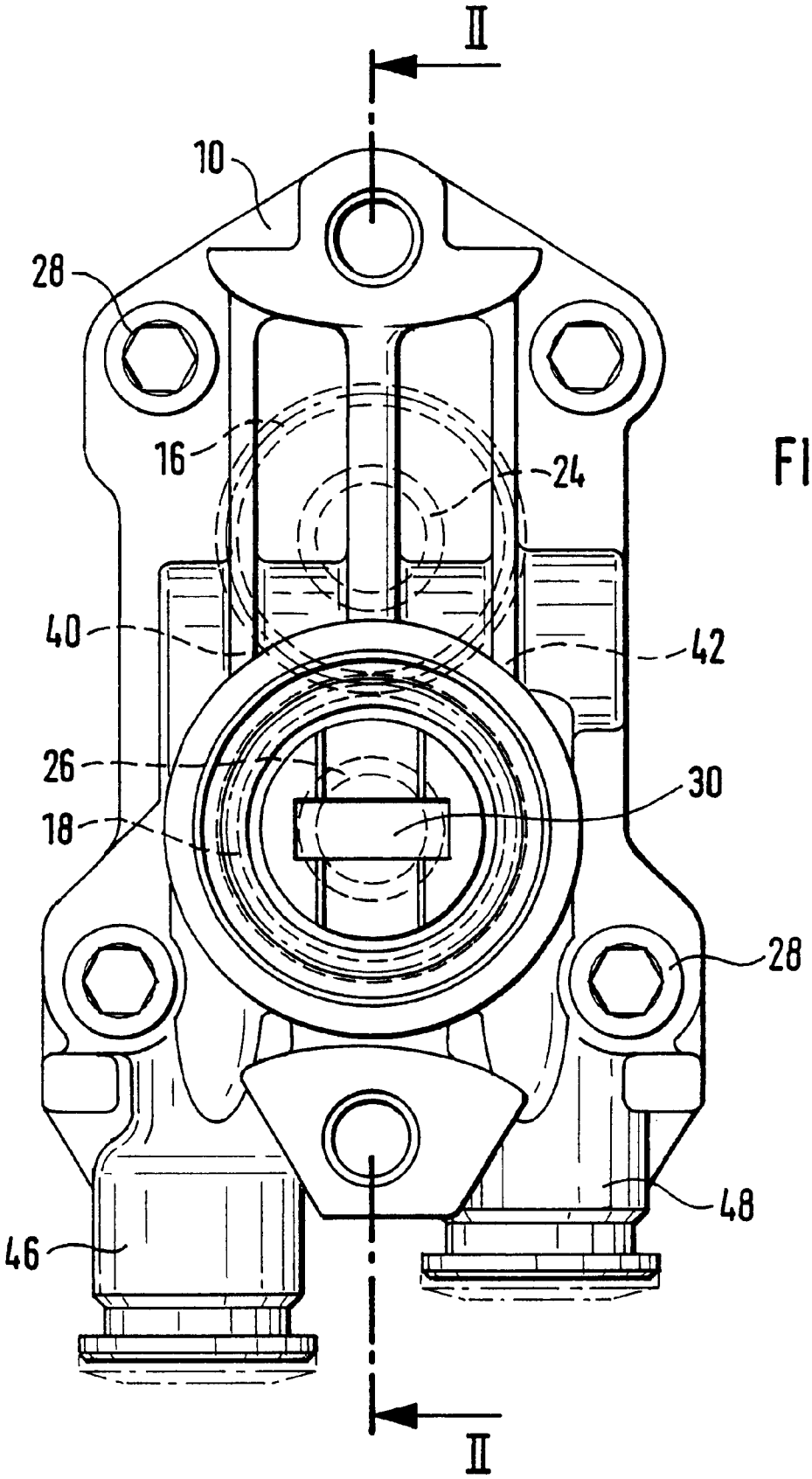
FIG. 1 shows a geared feed pump in a view in the direction of arrow I in FIG. 2.

A geared feed pump shown in FIGS. 1–5 is disposed in a feed line, not shown, from a tank to a high-pressure fuel pump or fuel injection pump of an internal combustion engine of a motor vehicle. The engine is a self-igniting engine, and the fuel that is pumped by the geared feed pump is diesel fuel. The geared feed pump has a multiple-part housing, which comprises a housing part 10 and a cap part 12. Between the housing part 10 and the cap part 12, a pump chamber 14 is formed, in which a pair of gear wheels 16, 18 meshing with one another on their outer circumference is disposed. The housing part 10, to form the pump chamber 14, has two indentations 20, 22, from the bottom of each of which a respective bearing journal 24, 26 protrudes. The bearing journals 24, 26 are embodied integrally with the housing part 10 and extend at least approximately parallel to one another. To reduce the weight of the housing part 10, the bearing journals 24, 26 can be embodied as hollow, at least in part. The gear wheel 16 has a bore 17, by way of which it is rotatably supported on the bearing journal 24. The gear wheel 18 has a bore 19, by way of which it is rotatably supported on the bearing journal 26. The cap part 12 is solidly connected to the housing part 10, for instance by means of a plurality of screws 28. The housing part 10 and cap part 12 are preferably of light metal, in particular aluminum. The gear wheels 16, 18 are preferably of steel, in particular sintered steel.

The geared feed pump has a drive shaft 30, which is rotatably supported in the housing part 10. The drive shaft 30 is disposed at least approximately coaxially with the bearing journal 24, and the housing part 10 has a bore 32 that continues in the bearing journal 24 and through which the end of the drive shaft 30 passes. A shaft sealing ring 34 is built in between the bore 32 and the drive shaft 30 to seal off the housing part 10. The drive shaft 30 is coupled with the gear wheel 16, for instance via a coupling member 36 disposed between the face end of the bearing journal 24 and the cap part 12. In operation of the geared feed pump, the gear wheel 16 is driven to rotate via the drive shaft 30 and transmits this rotary motion via a spur gear to the gear wheel 18, which is also provided with a spur gear and which meshes with the gear wheel 16 on its outer circumference. The gear wheels 16, 18 by their meshing of teeth, divide the pump chamber 14 into two portions, of which a first portion forms an intake chamber 40 and a second portion forms a pressure chamber 42. The intake chamber 40 communicates with the pressure chamber 42 via a respective feed conduit 44 formed between the grooves between teeth on the circumferential surfaces of the gear wheels 16, 18 and the upper and lower circumferential wall of the pump chamber 14. The intake chamber 40 and the pressure chamber 42 each have a connection opening in the wall of the housing part 10 or of the cap part 12, by way of which opening the intake chamber 40 communicates with an intake line, not shown, from the tank and the pressure chamber 42 communicates, via a feed line also not shown, with the suction chamber of the high-pressure fuel pump or fuel injection pump. The connection opening into the intake chamber 40 forms an inlet opening 46, and the connection opening into the pressure chamber 42 forms an outlet opening 48.

Figure 2:
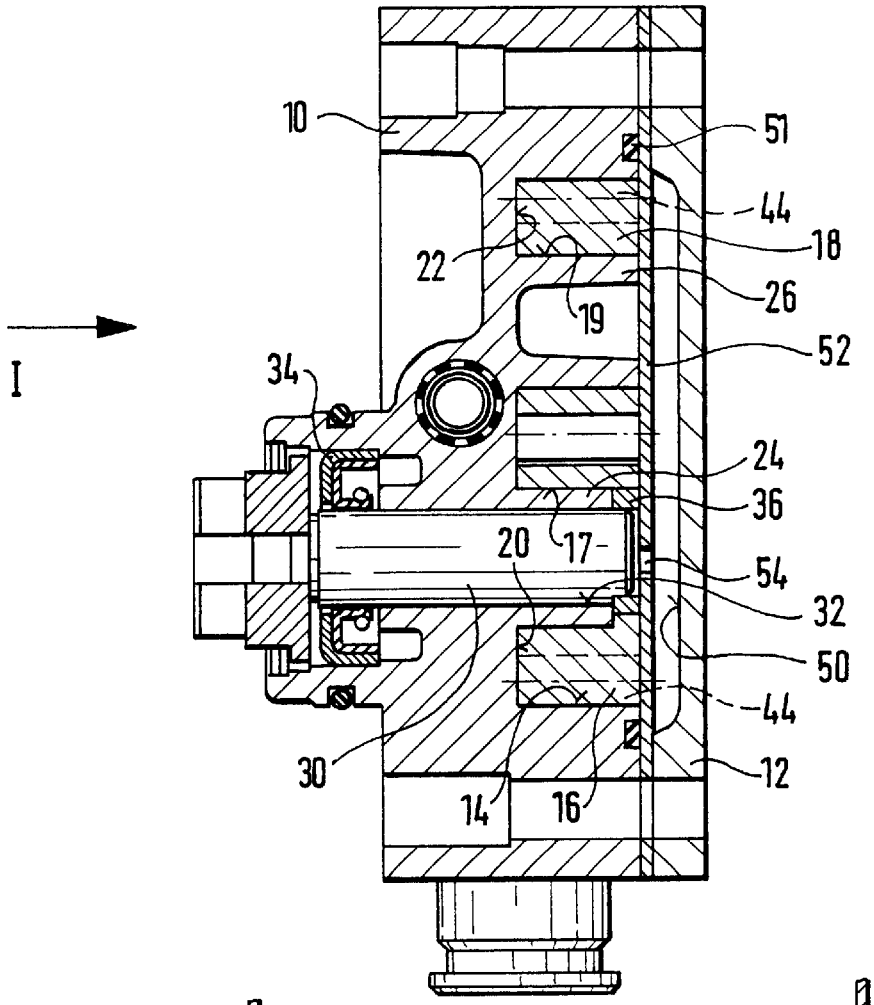
FIG. 2 shows the geared feed pump in a cross section taken along the line II—II of FIG. 1 for a first exemplary embodiment.

In FIG. 2, the geared feed pump is shown in a first exemplary embodiment. The cap part 12, in its inside toward the housing part 10, has an indentation 50, which is embodied at least in a region in which the face ends of the gear wheels 16, 18 are opposite the cap part 12. The cross section of the indentation 50 is at least as large as the cross section of the face ends of the gear wheels 16, 18. Fixed between the housing part 10 and the cap part 12 is a platelike cover element 52, which contacts the face end of the housing part 10 that surrounds the pump chamber 14 and also contacts the face ends of the gear wheels 16, 18. The cover element 52 is fastened, in a peripheral region located outside the face ends of the gear wheels 16, 18, between the face ends of the housing part 10 and the cap part 12, and in the region of the indentation 50, the cover element 52 rests with initial tension on the face ends of the gear wheels 16, 18 and is spaced apart from the indentation 50. Thus the cover element 52 is disposed in stationary fashion relative to the gear wheels 16, 18. An elastic sealing element in the form of a sealing ring 51 is disposed between the housing part 10 and the cover element 52.

Figure 2A:
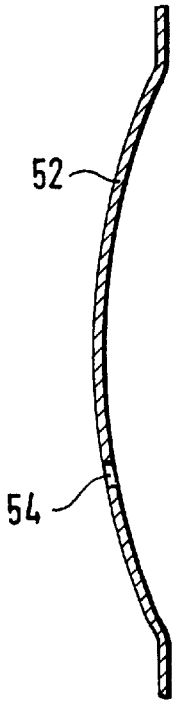
FIG. 2*a* shows a cover element in a first version.
Figure 2B:
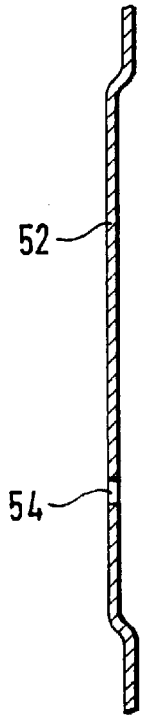
FIG. 2*b* shows the cover element in a second version.

The cover element 52 can have a curvature toward the face ends of the gear wheels 16, 18, but this curvature is not visible in the sectional view of the geared feed pump in FIG. 2. In FIGS. 2*a* and 2*b,* the cover element 52 is therefore also shown in the state in which it is not yet built in, to illustrate this curvature, which is shown highly exaggerated here. In a version shown in FIG. 2*a,* the cover element 52 has a convex curvature. In a version shown in FIG. 2*b,* to achieve the curvature, the cover element 52 has a region that is offset from the face ends of the gear wheels 16, 18. The cover element 52 is embodied as resiliently deformable, at least in its region contacting the face ends of the gear wheels 16, 18, and its initial tension is generated by the curvature and by the fastening of the cover element 52 between the housing part 10 and the cap part 12. The cover element 52 can for instance be of metal, in particular steel, or of plastic, and the thickness of the cover element 52 is selected so as to achieve the requisite elasticity of the cover element 52 in its region contacting the face ends of the gear wheels 16, 18. The cover element 52 has at least one opening 54, through which the indentation 50, which is closed by the cover element 52, communicates with the intake chamber 40. The sealing ring 51 is fastened between the face end of the housing part 10 and the cover element 52. By means of the cover element 52, the feed conduits 44 are sealed off in the direction of the pivot axes of the gear wheels 16, 18, so that no fuel can flow out as a leakage quantity from these feed conduits. Because of the resilient embodiment of the cover element 52, a requisite axial play of the gear wheels 16, 18 relative to the cap part 12 can be established as a result of the fact that the cover element 52 is deflected into the indentation 50. Because of the communication of the indentation 50 with the intake chamber 40 via the opening 54, air or fuel positively displaced when the cover element 52 is deflected into the indentation 50 can escape into the intake chamber 40. During operation of the geared feed pump, the gear wheels 16, 18, the housing part 10 and the cap part 12 heat up, and because of the different materials of which these elements are made, they expand to various extents. These different thermal expansions of the elements of the geared feed pump are likewise compensated for by the cover element 52; as a result, the feed conduits 44 are securely sealed, and seizing of the gear wheels 16, 18 from excessively slight axial play is prevented. During operation of the geared feed pump, as a result of the pressure buildup in the feed conduits 44, a force in the axial direction is also generated on the cover element 52, and as a result the cover element is pressed into the indentation 50, and an axial play of the gear wheels 16, 18 is generated. At the onset of operation of the geared feed pump, the cover element 52 rests with initial tension on the face ends of the gear wheels 16, 18, so that particularly in this operating state of the geared feed pump, only slight leakage losses occur.

Figure 3:
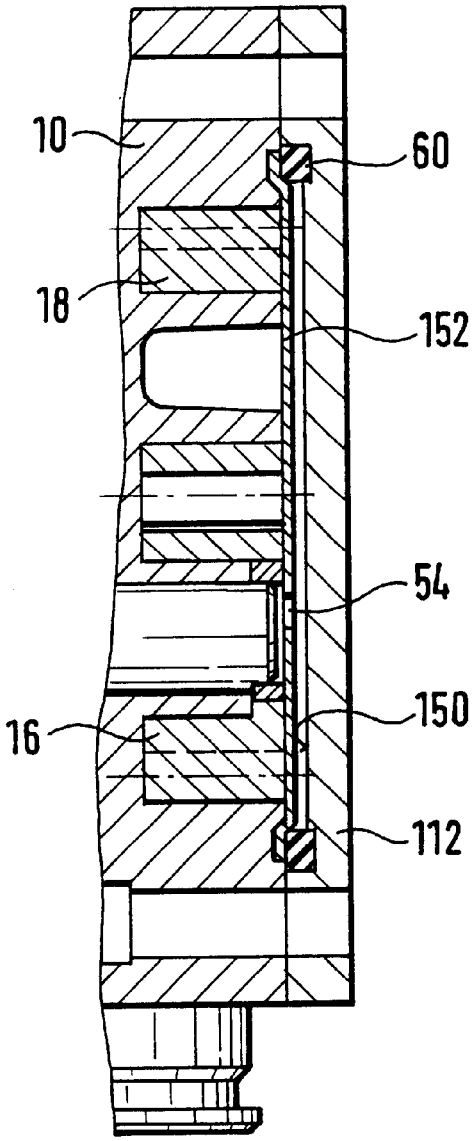
FIG. 3 shows the geared feed pump in cross section in accordance with a second exemplary embodiment.

In FIG. 3, the geared feed pump is shown in a second exemplary embodiment, in which the basic design is the same as in the first exemplary embodiment, but the cap part 112 and the cover element 152 are modified. The cap part 112, on its inside toward the face ends of the gear wheels 16, 18, has the indentation 150, which is somewhat larger in cross section than the cross-sectional areas of the face ends of the gear wheels 16, 18. Once again, the cover element 152 is embodied in platelike fashion and is fixed, in its region located outside the face ends of the gear wheels 16, 18, between the housing part 10 and the cap part 112. Once again, the cover element 152 is disposed in stationary fashion relative to the gear wheels 16, 18. The cover element 152 is supported on the cap part 112, and in particular on the bottom of the indentation 150 thereof, via an elastic sealing element 60. The sealing element 60 is embodied as a sealing ring, which extends along the outer edge of the cover element 152 and on which the cover element rests in the direction of the pivot axes of the gear wheels 16, 18. The cover element 152 can be embodied as resiliently deformable or relatively rigid, and it can be of metal or plastic. The cover element 152 can have a convex curvature oriented toward the face ends of the gear wheels 16, 18, or can be embodied as at least approximately flat. A requisite axial play of the gear wheels 16, 18 can be established by an axial motion of the cover element 152, as a result of compression of the sealing ring 60. When the geared feed pump is not in operation, the cover element 152 rests on the face ends of the gear wheels 16, 18 with an initial tension, which is generated by the sealing ring 60. The function of the cover element 152 to enable a requisite axial play is the same as in the first exemplary embodiment, as a result of the fact that the cover element can be deflected into the indentation 150. The cover element 152 has the opening 54 for providing communication between the indentation 150 and the intake chamber 40.

Figure 4:
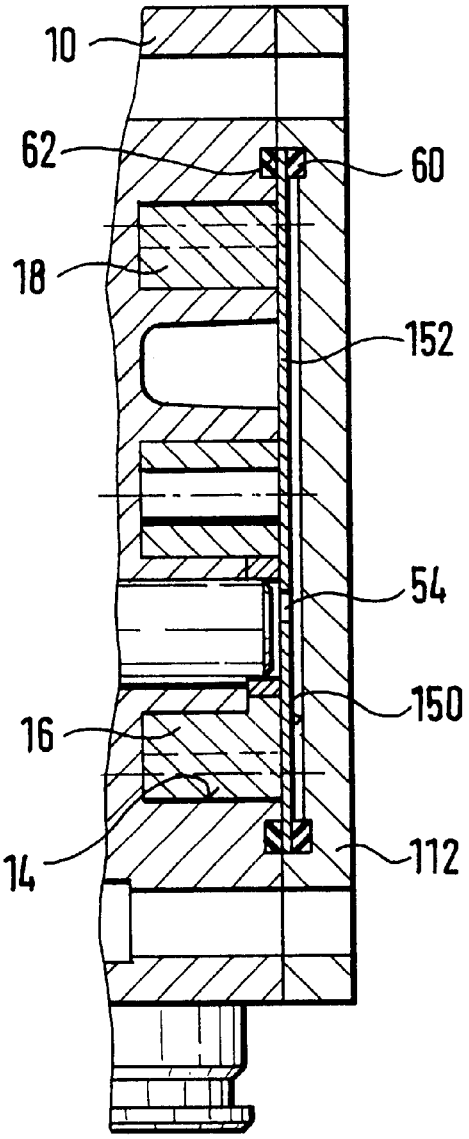
FIG. 4 shows the geared feed pump in cross section, in a version modified over a second exemplary embodiment.

FIG. 4, the geared feed pump is shown in a version modified only slightly over the second exemplary embodiment; in this version, the design is virtually identical to the second exemplary embodiment. In a departure from the second exemplary embodiment, the cover element 152 in the modified version of FIG. 4 is also braced on the housing part 10 via an elastic sealing 62 which in particular is embodied in the form of a sealing ring, which like the sealing ring 60 extends on the cap part 112 along the outer edge of the cover element 152. The function of the cover element 152 is the same as that described above for the second exemplary embodiment.

Figure 5:
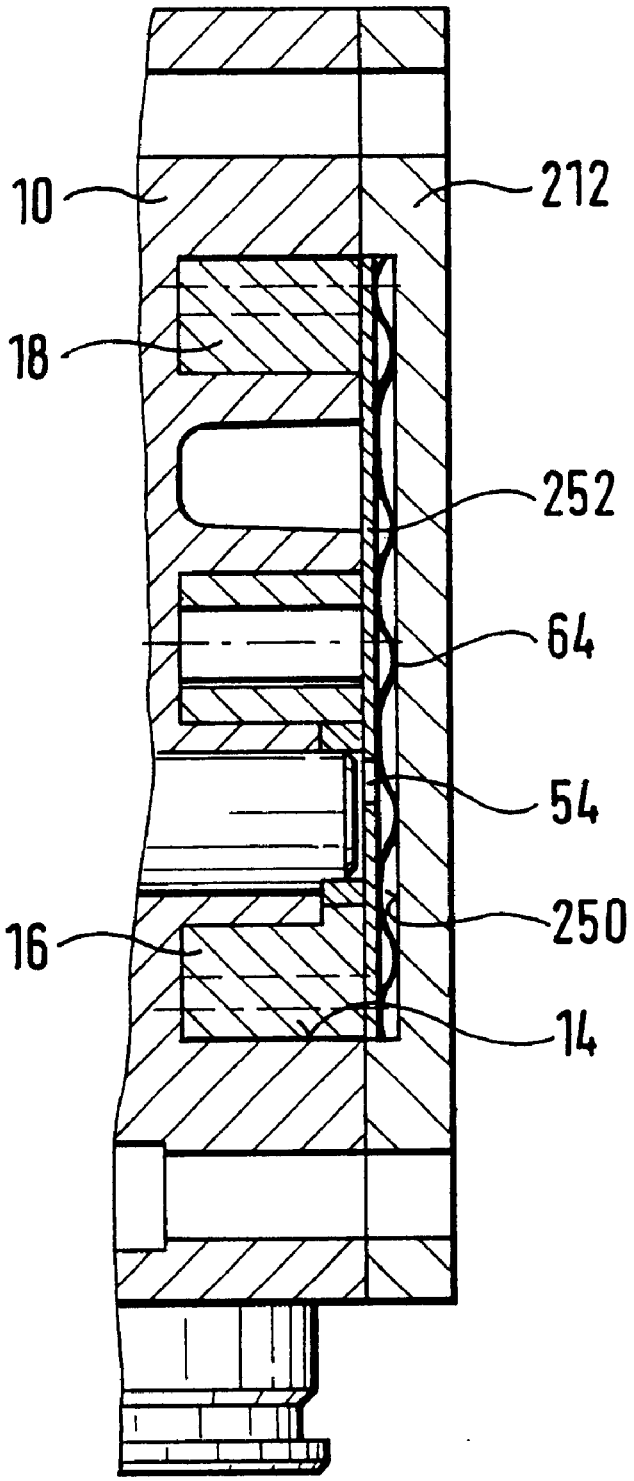
FIG. 5 shows the geared feed pump in cross section in a third exemplary embodiment.

In FIG. 5, the geared feed pump is shown in a third exemplary embodiment. The fundamental design of the geared feed pump is the same as in the exemplary embodiments described above. The cap part 212 of the geared feed pump is connected to the housing part 10 and has an indentation 250, which in its cross-sectional shape is embodied at least approximately identically to the cross-sectional shape of the pump chamber 14 and is disposed at least approximately congruently with the pump chamber 14. A cover element 252 is disposed in the indentation 250, and the cross-sectional shape of the cover element is at least approximately the same as that of the indentation 250. The cover element 252 is disposed so as to be nonrotatable in the indentation 250 and is thus stationary relative to the gear wheels 16, 18. At least one resilient contact-pressure element 64 is disposed between the bottom of the indentation 250 and the cover element 252; it presses the cover element 252 with initial tension against the face ends of the gear wheels 16, 18. The cover element 252 can be embodied rigidly and need not be resiliently deformable, and it can be of metal or plastic. The resilient contact-pressure element 64 can for instance be embodied as a wave washer, which can be of steel and which extends at least approximately over the entire surface of the cover element 252, resulting in a uniform contact pressure of the cover element 252 against the face ends of the gear wheels 16, 18. The cover element 252 has the opening 54 for connecting the indentation 250 with the intake chamber 40. If the geared feed pump is not in operation, then because of the resilient contact-pressure element 64, the cover element 252 rests with initial tension on the face ends of the gear wheels 16, 18. During operation of the geared feed pump, a requisite axial play of the gear wheels 16, 18 can be established as a result of the fact that the cover element 252 is deflected into the indentation 250, counter to the initial tension of the resilient contact-pressure element 64.

The foregoing relates to the preferred exemplary embodiments of the invention, it being understood that other variants and embodiments thereof are possible within the spirit and scope of the invention, the latter being defined by the appended claims.

We claim:

1. In a geared feed pump, having a housing in which, between a housing part (10) and a cap part (12; 112; 212), a pump chamber (14) is formed in which a rotationally driven pair of gear wheels (16, 18), meshing with one another on their outer circumference, is disposed, which pump a feed medium from an intake chamber (40), communicating with a feed medium supply tank, along feed conduits (44), formed between the outer circumference of the gear wheels (16,18) and circumferential walls of the pump chamber (14), into a pressure chamber (42), the cap part (12; 112; 212) being disposed opposite the face ends of the gear wheels (16, 18), the improvement wherein the cap part (12; 112; 212), on its inside oriented toward the face ends of the gear wheels (16, 18), has an indentation (50; 150; 250) with a cross section that is at least as large as the cross section of the face ends of the gear wheels (16, 18), and that between the cap part (12; 112; 212) and the face ends of the gear wheels (16, 18), a platelike cover element (52; 152; 252) that covers at least the indentation (50; 150; 250) is disposed, which, at least when the geared feed pump is not in operation, rests with initial tension against the face ends of the gear wheels (16,18), the cover element (52; 152; 252) has at least one opening (54), through which the indentation (50; 150; 250) communicates with the intake chamber (40).

2. The geared feed pump according to claim 1, wherein the cover element (52) is embodied as resiliently deformable, at least in its region contacting the face ends of the gear wheels (16, 18).

3. The geared feed pump according to claim 1, wherein the cover element (152) is braced on the cap part (112) and/or on the housing part (10) via a resilient support element (60, 62).

4. The geared feed pump according to claim 1, wherein the cover element (52; 152) is fixed, in a peripheral region located outside the face ends of the gear wheels (16, 18), between the cap part (12; 112) and the housing part (10).

5. The geared feed pump according to claim 1, wherein the housing part (10) and the cap part (12; 112; 212) are of light metal, and the gear wheels (16, 18) are of steel.

6. The geared feed pump according to claim 1, wherein the cover element (52) has a convex curvature oriented toward the face ends of the gear wheels (16, 18).

7. The geared feed pump according to claim 6, wherein the cover element (152) is braced on the cap part (112) and/or on the housing part (10) via a resilient support element (60, 62).

8. The geared feed pump according to claim 6, wherein the cover element (52; 152) is fixed, in a peripheral region located outside the face ends of the gear wheels (16, 18), between the cap part (12; 112) and the housing part (10).

9. The geared feed pump according to claim 6, wherein the housing part (10) and the cap part (12; 112; 212) are of light metal, and the gear wheels (16, 18) are of steel.

10. The geared feed pump according to claim 6, wherein the cover element (52) is embodied as resiliently deformable, at least in its region contacting the face ends of the gear wheels (16, 18).

11. The geared feed pump according to claim 10, wherein the cover element (52; 152) is fixed, in a peripheral region located outside the face ends of the gear wheels (16, 18), between the cap part (12; 112) and the housing part (10).

12. The geared feed pump according to claim 10, wherein the cover element (152) is braced o n the cap part (112) and/or on the housing part (10) via a resilient support element (60, 62).

13. The geared feed pump according to claim 12, wherein the resilient contact-pressure element (64) is a wave washer extending at least approximately over the entire cross section of the cover element (252).

14. The geared feed pump according to claim 12, wherein between the indentation (250) and the cover element (252), a resilient contact-pressure element (64) is fastened, by which the cover element (252) is pressed against the face ends of the gear wheels (16, 18).

15. The geared feed pump according to claim 14, wherein the resilient contact-pressure element (64) is a wave washer extending at least approximately over the entire cross section of the cover element (252).

16. The geared feed pump according to claim 6, wherein between the indentation (250) and the cover element (252), a resilient contact-pressure element (64) is fastened, by which the cover element (252) is pressed against the face ends of the gear wheels (16, 18).

17. The geared feed pump according to claim 16, wherein the resilient contact-pressure element (64) is a wave washer extending at least approximately over the entire cross section of the cover element (252).

18. The geared feed pump according to claim 1, wherein between the indentation (250) and the cover element (252), a resilient contact-pressure element (64) is fastened, by which the cover element (252) is pressed against the face ends of the gear wheels (16, 18).

19. The geared feed pump according to claim 18, wherein the resilient contact-pressure (64) is a wave washer extending at least approximately over the entire cross section of the cover element (252).

* * * * *